US005207265A

United States Patent [19]

Hasegawa et al.

[11] Patent Number: 5,207,265

[45] Date of Patent: May 4, 1993

[54] APPARATUS FOR CONTINUOUS CASTING OF METAL STRIP

[75] Inventors: Morihiro Hasegawa, Tokuyama; Takashi Yamauchi, Kudamatsu, both of Japan

[73] Assignee: Nisshin Steel Co., Ltd., Tokyo, Japan

[21] Appl. No.: 474,755

[22] PCT Filed: Jul. 27, 1989

[86] PCT No.: PCT/JP89/00751

§ 371 Date: Mar. 26, 1990

§ 102(e) Date: Mar. 26, 1990

[87] PCT Pub. No.: WO90/00948

PCT Pub. Date: Feb. 8, 1990

[30] Foreign Application Priority Data

Jul. 28, 1988 [JP] Japan ..... 63-186785

[51] Int. Cl.[5] ..... B22D 11/06

[52] U.S. Cl. ..... 164/428; 164/480

[58] Field of Search ..... 164/428, 480, 429, 479; 29/123

[56] References Cited

U.S. PATENT DOCUMENTS 4,811,780 3/1989 Yamauchi et al. ..... 164/428

*Primary Examiner*—Kuang Y. Lin

*Attorney, Agent, or Firm*—Lowe, Price, LeBlanc & Becker

[57] ABSTRACT

A twin roll continuous casting apparatus for continuously casting a metal strip through a gap of a pair of internally cooled rolls rotating in the opposite direction to each other having a pair of side dams disposed on both sides of the rolls wherein each side dam is made of an abradable refractory and forcibly fed in the casting direction, and wherein portions of the circumferential surfaces of the rolls contacting the side dams are formed into rough surfaces having an abrading ability and each of said portions having rough surfaces comprises a member removably fixed to the entity of the roll.

3 Claims, 4 Drawing Sheets

APPARATUS FOR CONTINUOUS CASTING OF METAL STRIP

TECHNICAL FIELD OF THE INVENTION

The present invention relates to an improvement in a twin roll continuous casting apparatus for continuously casting a metal strip directly from a molten metal such as a molten steel.

BACKGROUND OF THE INVENTION

Well known in the art is a so-called twin roll continuous casting apparatus in which a pair of internally cooled rolls having respectively horizontal axes and rotating in opposite direction to each other are disposed parallel to each other with an appropriate gap therebetween. A pool of molten metal is formed on the circumferential surfaces (the upper halves of cylindrical surfaces in the axial directions) of the rolls above the gap and the molten metal is continuously cast into a metal strip through the gap while being cooled by the circumferential surfaces of the rotating rolls. There has also been proposed such a twin roll continuous apparatus applied to a case of continuous casting of steel to produce a steel strip directly from molten steel.

When a metal strip is continuously cast through a gap between a pair of rolls, it is necessary to form a pool of molten metal on the circumferential surfaces of the pair of rolls above the gap therebetween and to maintain a level of the molten metal in the pool substantially constant by continuously pouring the molten metal into the pool. In order to form the pool of molten metal, a pair of dams are provided having their surfaces perpendicular to the roll axes which prevent an overflow of molten metal along the roll axes on the circumferential surfaces of the rolls. These dams also serve usually to regulate the width of the cast strip and are referred to herein as "side dams". In addition to the side dams disposed at the left and right sides of the rolls, a pair of front and rear gates having their surfaces along the roll axes may be erected orthogonally to the side dams on the circumferential surfaces of the rolls so as to form a box-like pool for molten metal with the side dams and the front and rear gates. However, when the pair of rolls have sufficiently large radii respectively, the front and rear gates along the roll axes are not always needed. In this case, the circumferential surfaces of the pair of rolls function as the front and rear gates.

There are known, as the pair of side dams, movable side dams which urge a pair of endless metal belts, caterpillars and the like against both edge surfaces of the rolls (side surfaces of the rolls perpendicular to the roll axes) at a location of the roll gap and which move at a speed corresponding to the casting speed. Fixed side dams are known which have plate-like bodies of refractories fixed to left and right side surfaces of the rolls. Generally, with the latter fixed side dams, the constitution of the apparatus is simple and the control of running is not complicated, compared with the former movable side dams. Also known in the art is a system of combined side dams in which fixed side dams are combined with movable dams. See JP A-62-214,835 which corresponds to U.S. Pat. No. 4,754,802.

Two systems of the fixed side dams are known. One is a system in which the distance between the plate-like bodies of the fixed side dams is smaller than the roll width (the length of roll from one end to the other end), and the other is a system in which the distance is the same as the roll width. According to the former system, the pair of side dams are erected on the circumferential surfaces of the rolls such that the bottoms of the side dams slidably contact the circumferential surfaces of the rolls. According to the latter system, the side dams are fixedly provided so that the respective inside surfaces of the side dams slidably contact the side surfaces of the rolls, that is, the pair of side dams sandwich the pair of rolls on the side surfaces of the rolls.

Usually, the fixed side dams are made of refractory material having a good adiabatic property. This is because the molten metal contacting the side dams has to be prevented from being solidifed on the surfaces of the side dams. Adiabatic refractory materials generally have inferior wear resistance to that of solidified metal and are liable to have scratches. Thus, the fixed refractory side dams may be damaged during the running of the apparatus, and the increase of damages may bring about breakout of molten metal. Further, according to the system noted above in which the side dams are fixed so that they sandwich the rolls on their side surfaces, clearances may be formed between the side surfaces of the rolls and the inside surfaces of the side dams slidably contacting therewith due to pressure of the ends of the strip being cast applied at the time of passing through the roll gap. As a result, the molten meal may enter the clearances. If such troubles occur, stable casting may no longer be continued. Accordingly, it has generally been considered that refractory materials suitable for the side dams should have a good wear resistance and the highest possible strength.

During the continuous casting, a portion of molten metal in the poor forms thin solidified shells respectively on the surfaces of the rotating rolls, and then these shells pass through the gap between the twin rolls while growing along with rotation of the rolls. At this time, the solidified shells are depressed (rolled) at a portion in the neighborhood of the smallest gap between the rolls to form into a metal strip of a predetermined thickness. Thus, owing to this depression (rolling), the solidified shells tend to expand widthwise near the roll gap. As a result, the ends of the cast strip apply large pressure to the side dams. In the case or the movable side dams wherein the side dams are moved at a speed corresponding to the casting speed, a problem of friction between the side dams and the ends of of the cast strip is not substantially posed. In the case of the fixed side dams, however, large friction is inevitably generated between between the ends of the moving cast strip and the fixed side dams. The large friction can cause damage to the refractory side dams, occurrence of cracking and undesirably deformation of the ends of the cast strip, formation of clearances between the side surfaces of the rolls and the inside surfaces of the side dams slidably contacting therewith, and entrance of molten metal into the clearances so formed, all of which hinder stable continuous casting. These problems are especially serious in the case of continuous casting of steel wherein the material involved is higher melting and has higher strength, when compared with cases wherein lower melting and mild non-ferrous metals are concerned.

In Japanese Patent Application No. 62-84,555 (published as JP A-63-252,646 on Oct. 19, 1988, after the priority date of the present international application, that is, Jul. 22, 1988; the corresponding U.S. patent application was issued as U.S. Pat. No. 4,811,780 on Mar. 14, 1989.), we have proposed as a solution to the above-discussed problems a continuous casting apparatus for metal strip which may be said "abradable dam system" or "semi-movable dam system" intermediate between "movable" and "fixed" dam systems. According to our prior proposal, a refractory material capable of being well abraded is used as the material for the side dams, contrary to the prior art concept that refractory materials suitable for the side dams should have a good wear resistance and the highest possible strength. The abradable side dams are forcibly fed or moved in the casting direction during the casting while being frictionally abraded by slidably contacting surfaces of the rotating rolls and ends of the strip being cast. Repeated runs of continuous casting by the abradable dam system have indicated that further improvements are desired for a further stable running of continuous casting.

OBJECT OF THE INVENTION

The invention intends to improve the continuous casting apparatus of an abradable dam system which we have previously proposed in Japanese Patent Application No. 62-84,555 for the purpose of solving the problems discussed above.

DISCLOSURE OF THE INVENTION

An apparatus for continuously casting a metal strip according to the invention comprises a pair of internally cooled rolls rotating in the opposite direction to each other and disposed parallel to each other with their axes held horizontally. A pair of side dams for forming a pool of molten metal on the circumferential surfaces of the pair of rolls are provided, said side dams bring disposed with a space approximately corresponding to the width of a metal strip to be cast and so that at least a portion of the bottom of each dam may contact the circumferential surfaces of the rolls so as to allow at least a portion of the thickness of each side dam to be located on the circumferential surfaces of the rolls. A least those portions of said side dams which come in contact with the circumferential surfaces of the rolls are composed of a refractory material capable of being well abraded. mechanisms for forcibly feeding said side dams in the casting direction at a predetermined speed are provided, thereby continuously casting the molten metal in the pool into a metal strip through a gap between the pair of rolls while abrasively wearing said side dams at said portions contacting the circumferential surfaces of the rolls, characterized in that portions of the circumferential surfaces of the rolls contacting the side dams are formed into rough surfaces having an abrading ability. Each of said portions having rough surfaces comprises a member removably fixed to the entity of the roll. In preferred embodiments according to the invention, the member removably fixed to an entity of the roll is a disc having a roughened circumferential surface or a ring belt having a roughened outside surface.

DETAILED DESCRIPTION OF THE INVENTION

The invention will now be described in detail with reference to the drawings.

Figure 1:
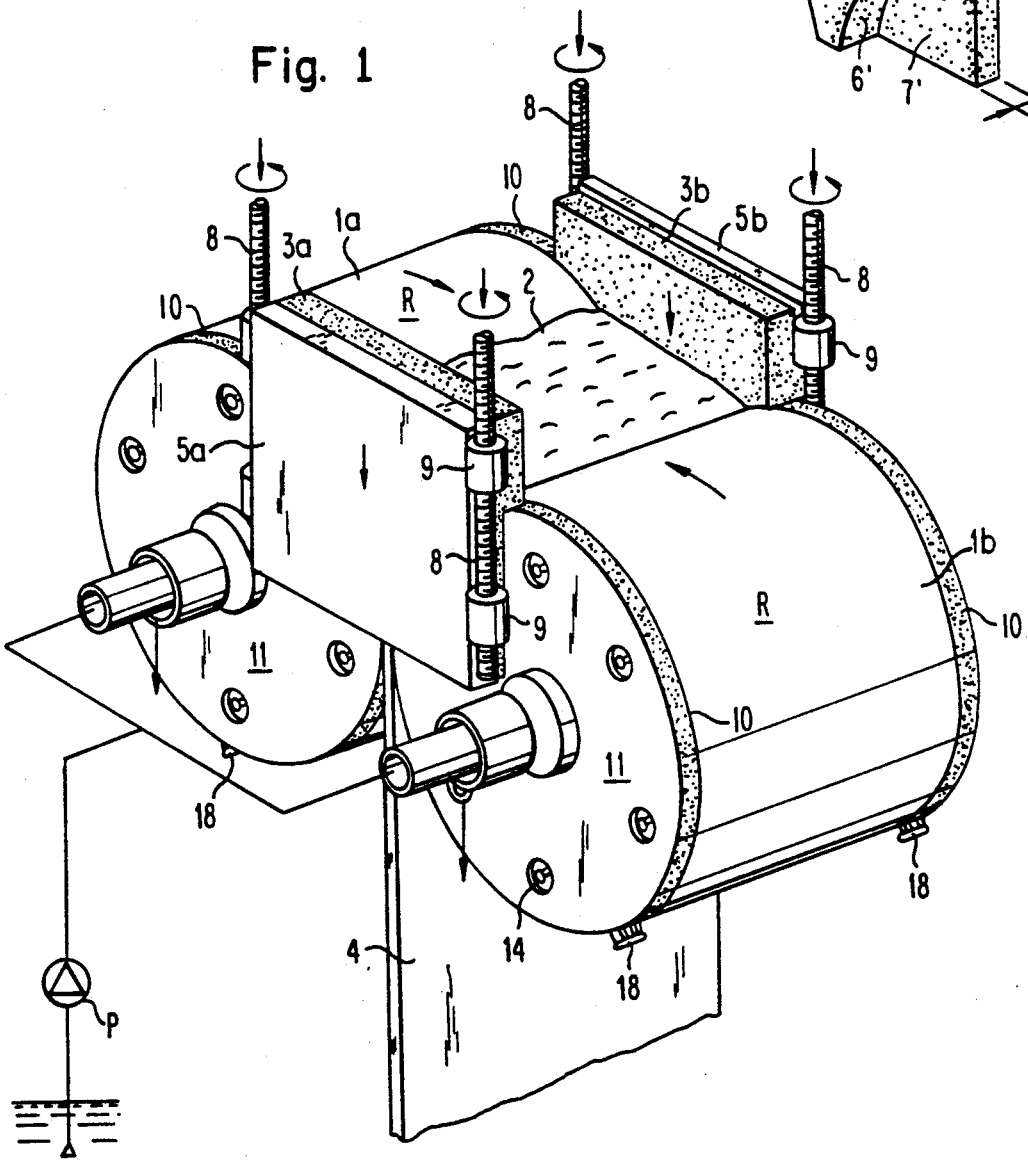
FIG. 1 is a perspective view showing principal portions of an embodiment of the apparatus according to the invention.

Referring to FIG. 1, reference numerals 1*a*, 1*b* designate a pair of internally cooled rolls rotating in the opposite direction to each other (the rotational directions of both rolls are shown by arrows) and opposed parallel to each other with their roll axes held horizontally. Reference numeral 2 designates a molten metal in a pool formed on the circumferential surfaces R of the pair of rolls 1*a*, 1*b*. Reference numerals 3*a*, 3*b* designate side dams and 4 a cast strip, respectively.

In either of the illustrated embodiments the rolls 1*a*, 1*b* are internally cooled with water. More specifically, the rolls 1*a*, 1*b* are formed on the inside of drums constituting the circumferential surfaces R with cooling water paths (not shown). The circumferential surfaces R are adapted to be cooled to a predetermined temperature by water passing through the cooling water paths. Cooling water is supplied to and drained from the cooling water path on the inside of the circumferential surface R through a shaft of each roll. Thus, the roll shaft is of a double pipe structure with an inner pipe serving as a supply pipe and an annular pipe path formed between outer and inner pipes serving as a drain pipe. In the interior of the roll, the cooling water supply pipe which is the inner pipe is connected to an inlet of the cooling water path provided inside the circumferential surface R, while the annular pipe path is connected to a cooling water outlet. When cooling water is continuously supplied from a pump P into the inner pipe as shown in FIG. 1, the supplied cooling water is circulated through the cooling water path located inside the circumferential surface R and then drained through the annular pipe path. The illustrated apparatus is constructed so that the operation of passing cooling water may be carried out even in the running of the apparatus.

Figure 2:
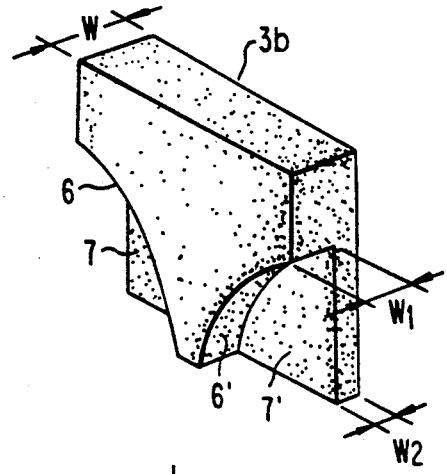
FIG. 2 is a perspective view showing an example of a shape of the refractory side dam in the apparatus of FIG. 1.

The side dams 3*a*, 3*b* are grasped by metal side dam cases 5*a*, 5*b* mounted on the outside surfaces of the side dams and moved in the casting direction. The side dams 3*a*, 3*b* themselves are made of a refractory material having a good abradability. The shape of each side dam is as shown in FIG. 2. One inner portion $W_1$ of the whole thickness W corresponds to a thickness of a portion installed on the circumferential surfaces R of the rolls and the other outer thickness $W_2$ corresponds to the thickness of a portion installed out of the the circumferential surfaces of the rolls, as shown in FIG. 2. Namely, the inner thickness portion $W_1$ has bottom surfaces 6, 6' worked to have curved surfaces corresponding to the circumferential shapes of the rolls 1a, 1b and the outer thickness portion $W_2$ is shaped to form portions 7, 7' slidably contacting side surfaces of the rolls 1a, 1b and extending to portions lower than the bottom surfaces 6, 6'. Materials constituting the side dams 3a, 3b should be not only adiabatic enough to prevent the molten metal from being solidified on inside surfaces of the side dams 3a, 3b, but also capable of being abraded by rough surfaces 10 of the circumferential surfaces of the rolls 1a, 1b. Further, they are preferably properly abraded by ends of the strip being cast. Examples of such suitable materials include, for example, adiabatic bricks, ceramic fiber boards and boron nitride (BN) which have good abradability, that is, a capability of being well abraded.

As shown in FIG. 1, on the outer surfaces of the refractory side dams 3a, 3b which are shaped as shown in FIG. 2 are mounted the metal side dam cases 5a, 5b to cover wholly the outer surfaces for grasping the side dams 3a, 3b. In this case, the curvedly worked bottom surfaces 6, 6' of the thickness portion $W_1$ contact the circumferential surfaces R of the rolls 1a, 1b, and the inner surfaces 7, 7' of the thickness portion $W_2$ slidably contact the side surfaces of the rolls 1a, 1b. The side dam cases 5a, 5b are supported by a plurality of struts 8 with screws through nuts 9 fixed to the case side. Each strut 8 is rotated about its own axis to move the side dam cases 5a, 5b in the casting direction. Thus. the side dams 3a, 3b during the running of the apparatus are lowered together with bottom surfaces 6, 6' being abraded by the circumferential surfaces of the rotating rolls. In addition to the mechanical engagement of the side dam cases 5a, 5b with the side dams 3a, 3b, they are preferably adhesively bonded together at the interfaces between them. Thus, the abradable side dam refractories with generally low tensile strength are reinforced. A system of continuously lowering the side dams is preferably used in a mechanism for moving the side dams downward. However, an intermittent moving system for repeatedly lowering and stopping the side dams, or a system for lowering with slight oscillation may also be used, depending on particular cases. In any case, the lowering speed of the side dam is preferably controlled in accordance with a detected signal on a lowering amount of the side dam or a width of the strip being cast.

Portions of the circumferential surfaces of the rolls slidably contacting the bottom surfaces 6, 6' of the side dams 3a, 3b are formed into rough surfaces having an abrading ability. The rough surface portions (4 portions) are designated by reference numeral 10 in FIG. 1. If the roughness and hardness of the portions 10 are properly selected according to the material of the side dams 3a, 3b and casting conditions, abrasion of the bottom surfaces 6, 6' of the side dams 3a, 3b adequately proceeds during casting. It is desirable that the adequate abrasion conditions are stationary and do not change with time.

For this purpose, in the apparatus according to the invention, each of the roughened surface portion 10 having an abrading ability is made into a member which can be removably fixed to an entity of the roll. By doing so, it is possible to provide a roughened surface having a desired abrading ability, irrespective of the material of the circumferential surface of the roll proper, and repair and exchange of the roughened surface can be carried out at will.

Figure 3:
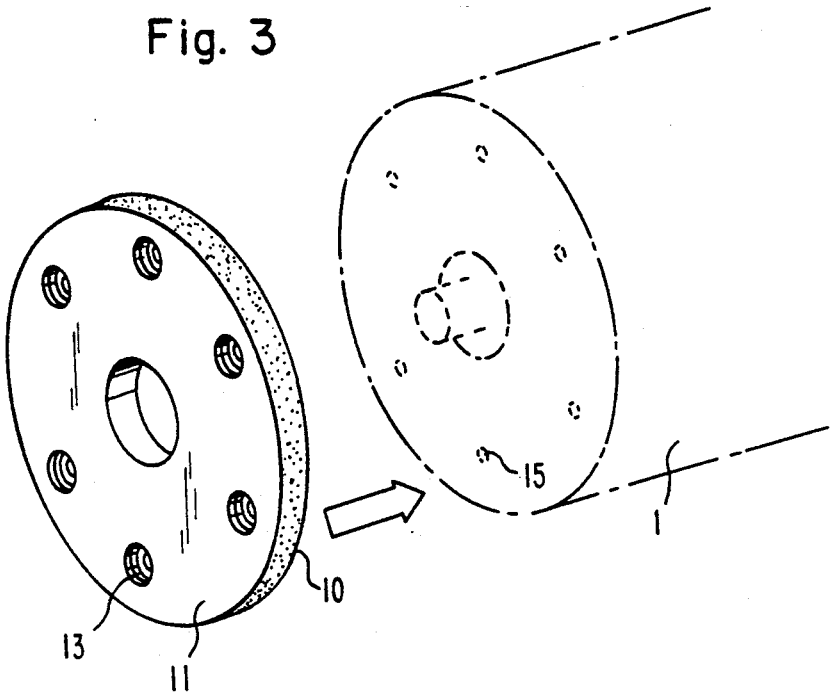
FIG. 3 is a fragmentary perspective view of a disc having a roughened circumferential surface which is removably fixed to the entity of the roll.

FIG. 3 shows a disc 11 which is removably fixed to the entity of the roll 1. The disc 11 has a diameter substantially the same as that of the entity of the roll 1, a thickness substantially the same as a slidably contacting width of the bottom surfaces 6, 6' of the side dam, and a roughened circumferential surface 10. Thus, by mounting the disc 11 having the roughened circumferential surface 10 on the side surface of the roll coaxially with the roll, there may be provided a surface for abrading the bottom surfaces 6, 6' of the side dams. The disc 11 may be conveniently fixed to the entity of the roll 1 by screwing bolts 14 (FIG. 1) through holes 13 provided in the disc 11 into threaded female holes formed in the side surface of the roll entity 1. If desired, the disc 11 may be divided into several segments. Namely, it may be radially divided into fan-shaped segments, which are to be individually fixed to the entity of the roll to form a disc shape as a whole. In the condition that the disc 11 is fixed to the roll entity 1 in position, the inside surfaces 7, 7' of the $W_2$ portion of the side dam shown in FIG. 2 are to come in slidable contact with an outer disc surface of the disc 11 (side surface of the roll) during the running of the apparatus. Thus, in some cases the outer disc surface of the disc 11 may also be made roughened so that it may appropriately abrade the inside surfaces 7, 7' of the side dam.

Figure 4:
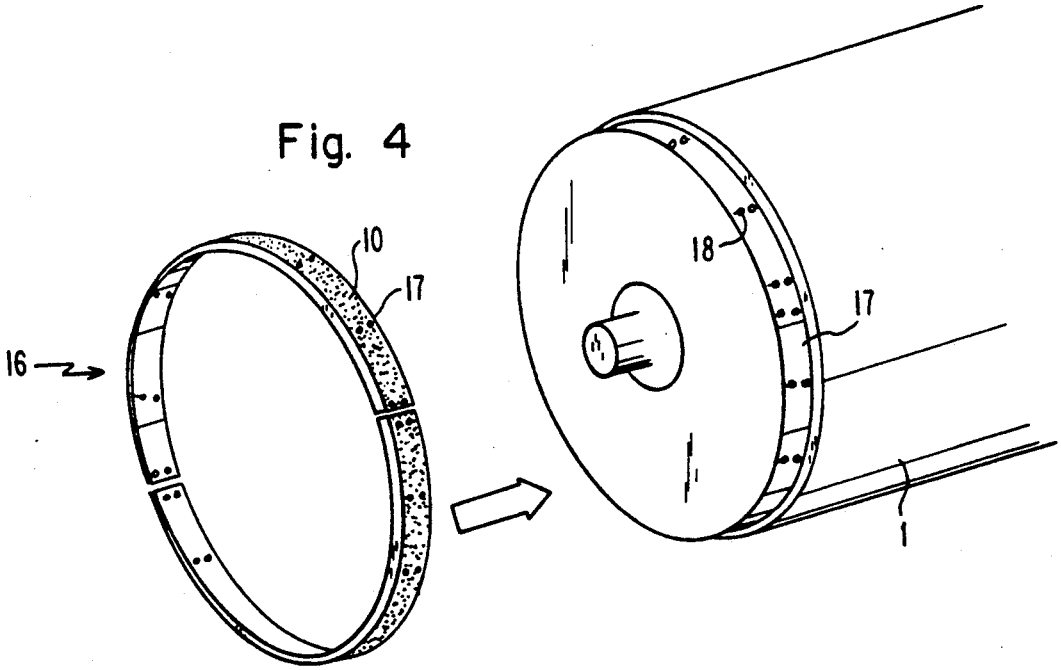
FIG. 4 is a fragmentary perspective view of a ring belt having a roughened outside surface which is removably fixed to the entity of the roll.

FIG. 4 shows a ring belt 16 which is removably fixed to the roll entity 1. The ring belt 16 has a roughened outside surface 10. On that each edge portion of the circumferential surface of the roll entity 1, which comes in slidable contact with the bottom surface 6, 6' of the side dam, there is formed a shallow groove 17 having a width corresponding to the width of slidable contact and a depth corresponding to the thickness of the belt 16, in which groove 17 the ring belt 16 is mounted. The ring belt 16 may be fixed to the roll entity 1 by threaded coupling engagement of bolts through small holes in the belt ring with small threaded female holes 18 formed on the roll entity side. If desired the ring belt may be circumferential divided into 2, 3 or 4 segments, which form a ring shape as a whole, when individually mounted on the roll entity in position.

Materials different from that constituting the circumferential surface R of the roll entity can be used for constituting the circumferential surface of either disc 11 or ring belt 16. The material of the circumferential surface R of the roll is inherently selected in consideration of required heat conductivity and formation of sound solidified shells. Accordingly, from the view point of sufficient abrading function it is often advantageous to form the abrading rough surface of a material other than that of the circumferential surface R of the roll entity instead of roughening the circumferential surface R of the roll. By doing so, the rough surface can be prepared separately from the preparation of the rolls, and can be exchanged for repair or renewal. An abrading rough surface may be formed on the circumferential surface of the disc 11 or ring belt 16 preferably by providing a layer of a hard material followed by roughening the so provided hard layer. The layer of a hard material may be formed advantageously by flame spraying of a hard metal such as Ni-Cr alloys, carbon steels and stainless steels, a ceramic such as $Cr_2O_3$, $TiO_2$, $Al_2O_3$ and $ZrO_2$, or a cermet such as $ZrO_2$-NiCr, $Cr_3C_2$-NiCr and WC-Co. If a flame spray coating is built under such conditions that surface depressions and extrusions may be naturally formed by deposition of flame sprayed particles, the resulting flame spray coating as such has a roughened surface which can perform the abrasive wear of the abradable side dam. To improve the adhesion of the flame spray coating to the substrate (surface to be flame sprayed), some kinds of substrate may be preferably subjected to pretreatment prior to flame spraying. For example, the substrate may be plated with metal prior to flame spraying. Furthermore, the substrate may be roughened by sand blasting, and then flame sprayed. In place of forming a rough surface by flame spraying, a rough surface may be formed by forming a layer of a hard metal by plating and roughening the so formed hard layer. Examples of suitable hard metal include Ni and Ni-base alloys, Ni-Fe alloys. Cr and Cr-base alloys and Fe alloys. If the surface of the plated metal is smooth, it should be roughened, for example by emery polish or sand blasting.

In the apparatus according to the invention, those portions of the circumferential surfaces of the rolls which come in slidable contact with the bottom portions 6, 6' of the side dams are constructed of the removable members 11, 16 which have a roughened surface 10 of a hard material and are removably fixed to the roll entity 1. The material of the roughened surface 10 can suitably selected so that the roughened surface may not be deteriorate and may maintain a good abrading ability for a prolonged period of time. Furthermore, the members 11, 16 are exchangable. By the way, a reference numeral 18 designates a brush for cleaning the rough portions 10. The brush 18 disposed in abutting engagement with the rough portions 10 acts to remove abraded powder generated by rotation of the rolls and attached to the rough surface of the portion 10, thereby preventing the rough surface from choking up with the abraded powder.

Figure 5:
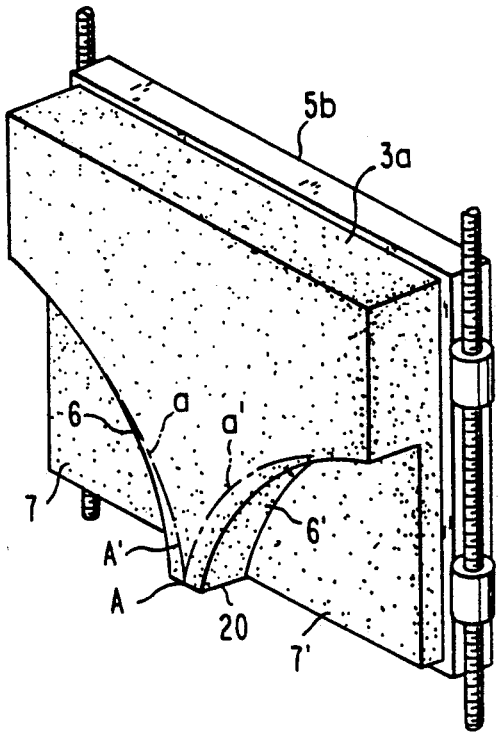
FIG. 5 is a perspective view of the side dam in the apparatus of FIG. 1 under the condition where the degree of abrasion of the dam is small at an early stage of the casting process.

FIG. 5 shows the internal surface condition of the side dam according to the invention at an early stage of the casting process. Side ends of solidified shells formed on the respective surfaces of the internally cooled rolls contact the internal surface of the side dam on the levels shown by reference symbols a, 1' in FIG. 5, and are combined together at point A. That is, a portion of molten metal in the pool is cooled on the surface of each roll and then solidified to thin shells. The solidified shells so formed on the surfaces of the respective rolls grow and combine together along with the rotation of the rolls, and the combined shells are rolled through the gap between the rolls to a predetermined thickness. During the course of this, ends of the solidified shells come in contact with the internal surface of each side dam on the level shown by a, a'. The initial configuration of the side dam (before it is abraded by running of the apparatus) is preferably determined such that the confluence A of the solidified shells (the position where the solidification of the shells is completed) will be located below the lower edge 20 of the side dam. However, during the casting process, the confluence A may be moved to a position A' above the position of the lower edge 20 due to variations in casting conditions. In this case, the widthwise expansion of the strip (the solidified metal strip which has passed the confluence) will abrade the corresponding (lower edge) portions of refractories. Unless the side dams are lowered under such conditions, the strip width is gradually increased. If the strip width exceeds the roll width, the strip formed may have a dog bone like cross-section with ends coming from the exceeding portions swollen, and in the further proceeding of casting, the side dams will be damaged, resulting in breakout of molten metal. Such situations can be avoided with the apparatus according to the invention, in which the dams of an abradable refractory material are lowered at a predetermined speed, and thus, new surfaces of the side dams are successively lowered even if the edge portions of the dams are abraded off by the ends of the strip being cast, and, in consequence stable casting of a metal strip with a predetermined width can be realized with the apparatus according to the invention.

Figure 6:
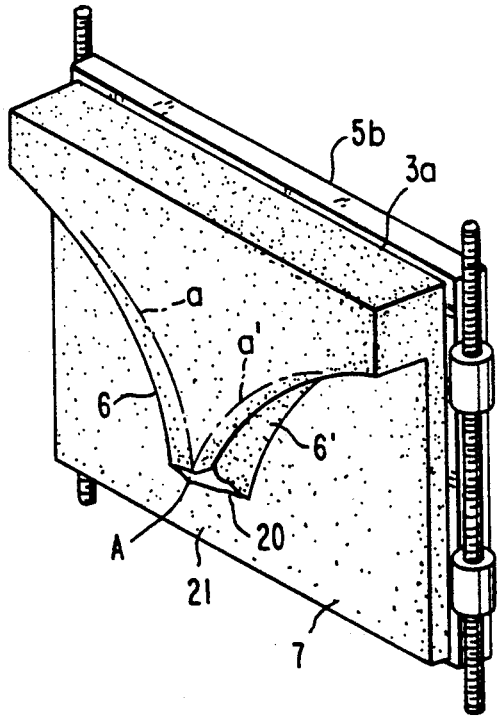
FIG. 6 is a perspective view of the side dam in the apparatus of FIG. 1 under the condition where the degree of abrasion of the dam is proceeded in the casting process.

FIG. 6 shows the internal surface of the side dam when it has been considerably lowered in the proceeding of casting. While the bottom surfaces 6, 6' and lower edge 20 of the side dams have been abraded by the rough surfaces 10 of the rolls and the side ends of the cast strip, respectively, and their positions have moved upward relative to the initial positions shown in FIG. 5, the lower edge 20 has been abraded by the strip ends into a somewhat slant condition. Below the lower edge 20, there is exposed an inside surface 21 of that portion of the side dam which extends beyond the width of the roll. This surface 21 may additionally serve to prevent leakage of molten metal. Incidentally, under the condition shown in FIG. 6 again, side ends of solidified shells formed on the respective surfaces of the rolls contact the internal surface of the slide dam on the levels a, a' and are combined together at the confluence A, as is the case under the condition shown in FIG. 5.

Figure 7:
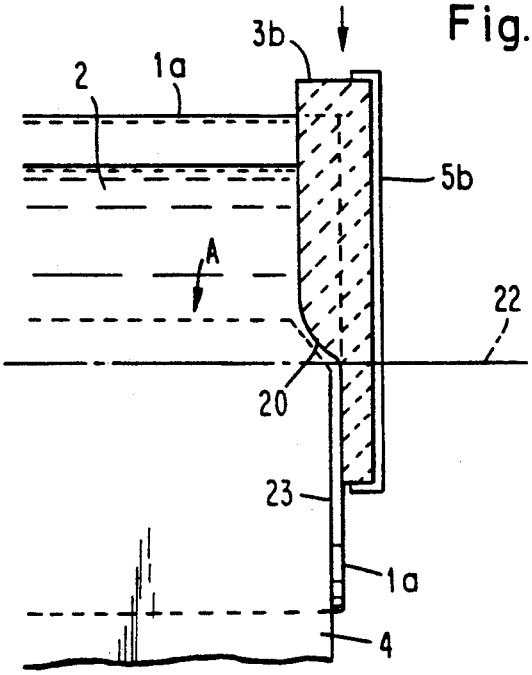
FIG. 7 is a schematic cross-sectional partial view of the apparatus of FIG. 1, showing a state of casting, as viewed in a plane parallel to the plane of the cast strip.

FIG. 7 shows schematically the process of casting corresponding to that in FIG. 6 As shown in FIG. 7, the lower edges 20 of the side dams may be maintained in the positions above the narrowest gap (at the center level of roll shaft 22) between the twin rolls by moving (lowering) forcibly downward the side dams, while the lower edges 20 are ground into sloped shapes. Thereby, the widthwise expansion of the strip which has passed the confluence A of the solidified shell is restrained. If the side dams are set to certain fixed positions without lowering them, it will be understood that the internal surfaces of the side dams will be successively ground by the shells and strip ends 23 which are expanded widthwise at the narrowest gap and eventually the molten metal will leak from the side dam portions which are ground when the strip width exceeds the roll width. This occurs not only in the case of refractories with satisfactory abradability, but also in the case of general refractories. When refractories having antiwear property are used, cracks take place, resulting in more dangerous conditions. Contrary to the prior conception of using refractories with antiwear property, the invention uses the side dams made of refractories which are liable to be ground. Then, the side dams forcibly lowers to positively grind refractories. As a result, a stable casting may be carried out without presenting the above mentioned problems. By employing such lowering speed, the bottom surfaces 6, 6' of the side dams contacting the circumferential surfaces of the rolls and the internal surfaces (substantially near the lower edges 20) of the side dams contacting the shells and cast strip ends are ground while maintaining the shapes of these bottom and internal surfaces of the side dams substantially similar. More particularly, such lowering speed is employed such that the grinding speed of the shells and strip ends near the lower edges 20 does not exceed the grinding speed of the bottom surfaces 6, 6' of the side dams, i.e.

the side dams are allowed to lower such that the latter speed becomes higher than the former speed. In addition, the abrading tough surface 10 according to the invention is prepared from a material different from that of the roll entity 1 and removably is fixed to the roll entity 1, whereby a power of abrading the side dams may be enhanced, maintenance of the apparatus my become easy, and optimum abrading conditions may be stationarily maintained, thereby ensuring a still stable continuous casting.

Figure 8:
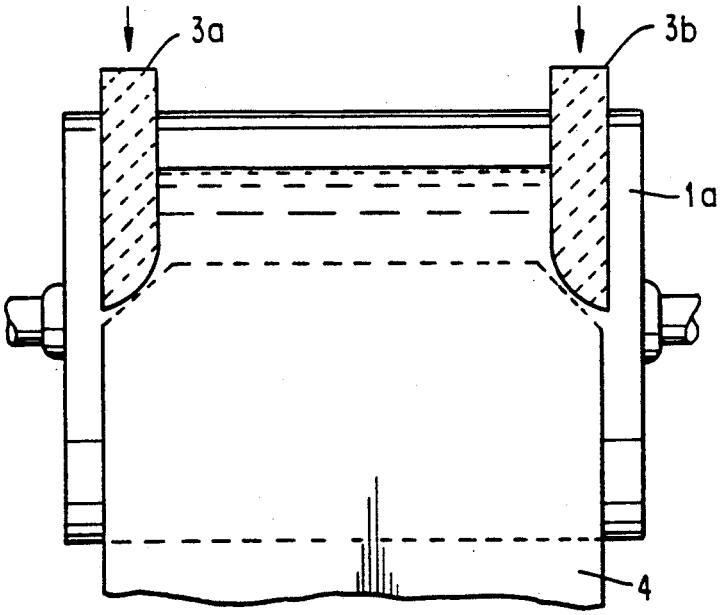
FIG. 8 is a schematic cross-sectional partial view of another embodiment of the apparatus according to the invention, as viewed in a plane parallel to the plane of the cast strip.

Further, while heretofore has been described an example of the side dams having one portion of thickness within the roll width and the other portion of thickness outside the roll width, the invention may also be applied to a system in which the whole thickness of the side dam comes within the roll width. FIG. 8 shows this example. As shown by the arrows, in this case again, the side dams *3a, 3b* are moved downward and the side dams *3a, 3b* themselves are of course made of refractories with satisfactory abradability.

We claim:

1. An apparatus for continuously casting a metal strip comprising a pair of internally cooled rolls rotating in the opposite direction to each other and disposed parallel to each other with their axes held horizontal, a pair of side dams for forming a pool of molten metal on the circumferential surfaces of the pair of rolls, said side dams being disposed with a space approximately corresponding to the width of a metal strip to be cast and so that at least a portion of the bottom of each dam may contact the circumferential surfaces of the rolls so as to allow at least a portion of the thickness of each side dam to be located on the circumferential surfaces of the rolls, at least those portions of said side dams which come in contact with the circumferential surfaces of the rolls being composed of a refractory material capable of being well abraded, and mechanisms for forcibly feeding said side dams in the casting direction at a predetermined speed, thereby continuously casting the molten metal in the pool into a metal strip through a gap between the pair of rolls while abrasively wearing said side dams at said portions contacting the circumferential surfaces of the rolls, characterized in that portions of the circumferential surfaces of the rolls contacting the side dams are formed into rough surfaces having an abrading ability; and each of said portions having rough surfaces comprises a member removably fixed to the entity of the roll.

2. The apparatus for continuously casting a metal strip according to claim 1 wherein said member removably fixed to the entity of the roll comprises a disc having a roughened circumferential surface.

3. The apparatus for continuously casting a metal strip according to claim 1 wherein said member removably fixed to the entity of the roll comprises a ring belt having a roughened outside surface.

* * * * *